US009109764B2

(12) United States Patent
Fett et al.

(10) Patent No.: US 9,109,764 B2
(45) Date of Patent: Aug. 18, 2015

(54) DURABLE LIGHTING APPARATUS WITH ISOTROPIC RADIATION PATTERN

(71) Applicant: IP DESIGN LLC, Bluffton, OH (US)

(72) Inventors: David Fett, Bluffton, OH (US); Bob Hayes, Westerville, OH (US); Don Staufenberg, Dublin, OH (US); Luke Stonis, Columbus, OH (US)

(73) Assignee: IP DESIGN LLC, Bluffton, OH (US)

( * ) Notice: Subject to any disclaimer, the term of this patent is extended or adjusted under 35 U.S.C. 154(b) by 151 days.

(21) Appl. No.: 13/649,835

(22) Filed: Oct. 11, 2012

(65) Prior Publication Data

US 2013/0094223 A1 Apr. 18, 2013

Related U.S. Application Data

(60) Provisional application No. 61/546,205, filed on Oct. 12, 2011.

(51) Int. Cl.

| | |
|---|---|
| ***F21V 21/10*** | (2006.01) |
| ***F21L 14/02*** | (2006.01) |
| ***F21V 15/01*** | (2006.01) |
| ***F21V 19/00*** | (2006.01) |
| *F21S 6/00* | (2006.01) |

(Continued)

(52) U.S. Cl.

CPC ..... *F21L 14/02* (2013.01); *F21V 15/01* (2013.01); *F21V 19/0075* (2013.01); *F21S 6/00* (2013.01); *F21V 21/116* (2013.01); *F21V 21/40* (2013.01); *F21Y 2103/022* (2013.01)

(58) Field of Classification Search

CPC ..... F21Y 2101/02; F21S 2/005; F21S 6/00; F21V 23/00; F21V 23/04; F21V 23/06; F21V 29/004; F21V 21/04; F21V 21/34; F21V 21/36; F21V 15/013; F21V 21/005; F21V 15/01; F21V 19/0075; F21V 21/116; F21V 21/40; F21W 2131/1005; F21K 9/135; F21K 9/13; F21L 14/00; F21L 14/02; F21L 14/023; H01R 12/7076

USPC ..... 362/167–168, 174, 176–177, 184–188, 362/249.01–249.05, 448, 421, 443, 362/368–372, 390, 376, 384, 353, 190–191, 362/197–198, 27, 249.07–249.09, 362/249.11–249.13, 285, 287, 233, 362/249.07–249.11, 362–363, 410, 362/413–414, 418–419, 427–430

See application file for complete search history.

(56) References Cited

U.S. PATENT DOCUMENTS 2,724,046 A * 11/1955 Grosz ..... 362/184
3,591,795 A * 7/1971 Neesbye-Hansen ..... 362/184

(Continued)

FOREIGN PATENT DOCUMENTS

JP H10188654 A * 7/1998 ..... F21V 21/34

*Primary Examiner* — Jason Moon Han

(74) *Attorney, Agent, or Firm* — Standley Law Group LLP

(57) ABSTRACT

Disclosed herein is a durable lighting apparatus having a plurality of light sockets arranged within a translucent housing such that when the light sockets are fitted with lamps and energized the lamps emit a substantially isotropic radiation pattern through the translucent housing. The light sockets are preferably attached to a flexible substrate which allows the device to absorb shock without damaging the sockets. In a preferred embodiment, the socket assembly is permitted to slide vertically along a central column where shock-absorbing devices are positioned above and below the socket assembly.

19 Claims, 4 Drawing Sheets

(51) Int. Cl.

| | |
|---|---|
| *F21V 21/116* | (2006.01) |
| *F21V 21/40* | (2006.01) |
| *F21Y 103/02* | (2006.01) |

(56) References Cited

U.S. PATENT DOCUMENTS

| | | | | | |
|---|---|---|---|---|---|
| 4,092,706 | A | | 5/1978 | Vest | |
| 5,117,345 | A | | 5/1992 | Baake | |
| 5,257,172 | A | * | 10/1993 | Erickson | 362/657 |
| 5,528,477 | A | | 6/1996 | Carmo | |
| 5,564,821 | A | | 10/1996 | Hesprich | |
| 5,599,090 | A | * | 2/1997 | Waldmann | 362/267 |
| 5,860,730 | A | | 1/1999 | Hesprich | |
| 6,386,736 | B1 | | 5/2002 | Reiff | |
| 6,629,767 | B2 | | 10/2003 | Osiecki | |
| 6,787,990 | B2 | * | 9/2004 | Cok | 313/504 |
| 7,033,065 | B2 | | 4/2006 | Leung | |
| 7,063,444 | B2 | * | 6/2006 | Lee et al. | 362/285 |
| 7,097,324 | B2 | | 8/2006 | Galvez | |
| 8,066,401 | B2 | | 11/2011 | Leung | |
| 8,070,323 | B2 | | 12/2011 | Wechsler | |
| 2009/0139781 | A1 | * | 6/2009 | Straubel | 180/65.1 |
| 2009/0310354 | A1 | * | 12/2009 | Zampini et al. | 362/235 |

* cited by examiner

DURABLE LIGHTING APPARATUS WITH ISOTROPIC RADIATION PATTERN

CROSS-REFERENCE TO RELATED APPLICATIONS

This application claims priority to U.S. Application No. 61/546,205, filed on Oct. 12, 2011, which is herein incorporated by reference in its entirety.

TECHNICAL FIELD

Embodiments generally relate to durable lighting apparatus with a radiation pattern that is generally isotropic.

BACKGROUND OF THE ART

Utility lights are commonly used to complete a task where typical illumination (daylight, overhead lighting, etc.) is not available. This situation can occur in an outdoor area simply because it is dusk, night, or dawn. This situation can also occur in areas of a home, business, or industrial setting that are not typically occupied and/or simply contain an inadequate amount of lighting for the task at hand (basements, crawl spaces, HVAC enclosures, attics, garages, closets, etc.). This situation can also occur during the initial construction of a home, business, or industrial setting where the overhead lighting has not been wired up or otherwise installed. Painting, pluming, HVAC, drywall, electrical, and any other general contractor may require additional illumination during construction.

Existing devices have typically used incandescent, halogen, or other high discharge lamps for these utility lights, which suffer from a number of drawbacks including large amounts of heat generated from the lamp, easily damaged glass or filaments in the lamp, low efficiency, short life span, and a largely directional nature of the resulting radiation pattern.

SUMMARY OF THE EXEMPLARY EMBODIMENTS

The socket and lamps are placed within a translucent housing so that light may be emitted from the apparatus in a substantially isotropic pattern. In other words, light is emitted from all sides of the apparatus, preferably in a substantially equal manner. This allows the apparatus to be oriented in any number of positions (above the work area, next to the work area, below the work area, etc.) and still provide adequate light. Further, the use of fluorescent lights provides an increase in efficiency and produces very little heat when compared to other technologies. Thus, the apparatus may be used in close proximity to heat sensitive or flammable objects without the risks that are inherent in other technologies. The sockets are mounted within a flexible substrate which allows the lamps and sockets to oscillate when the apparatus is under some type of shock and/or vibration, preventing damage to both. The socket assembly is permitted to travel vertically along a central column while utilizing a pair of shock absorbing devices which allow the apparatus to absorb even further shock and/or vibration without damage to the lamps and sockets.

The foregoing and other features and advantages of the present invention will be apparent from the following more detailed description of the particular embodiments, as illustrated in the accompanying drawings.

BRIEF DESCRIPTION OF THE DRAWINGS

A better understanding of an exemplary embodiment will be obtained from a reading of the following detailed description and the accompanying drawings wherein identical reference characters refer to identical parts and in which.

DETAILED DESCRIPTION

Figure 1:
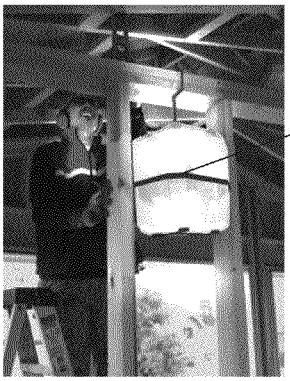
FIG. 1 is a perspective illustration of an exemplary lighting apparatus suspended from above the apparatus.

The invention is described more fully hereinafter with reference to the accompanying drawings, in which exemplary embodiments of the invention are shown. This invention may, however, be embodied in many different forms and should not be construed as limited to the exemplary embodiments set forth herein. Rather, these embodiments are provided so that this disclosure will be thorough and complete, and will fully convey the scope of the invention to those skilled in the art. In the drawings, the size and relative sizes of layers and regions may be exaggerated for clarity.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the invention are described herein with reference to illustrations that are schematic illustrations of idealized embodiments (and intermediate structures) of the invention. As such, variations from the shapes of the illustrations as a result, for example, of manufacturing techniques and/or tolerances, are to be expected. Thus, embodiments of the invention should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

FIG. 1 is a perspective illustration of an exemplary lighting apparatus suspended from above the apparatus. The lighting apparatus 100 provides illumination in all directions surrounding the device. Thus, it is not necessary to precisely position or re-position the lighting apparatus 100 during the task as all of the surrounding area is illuminated. By placing one or more of the lighting apparatuses 100 near the center of a room, the entire room is illuminated, removing the need to precisely position or re-position the lighting apparatus 100 during the task.

Figure 2:
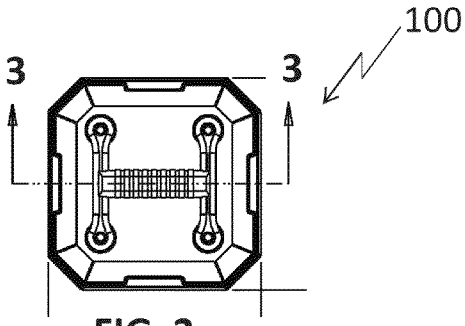
FIG. 2 is a top elevation view of an exemplary embodiment of the lighting apparatus.
Figure 3:
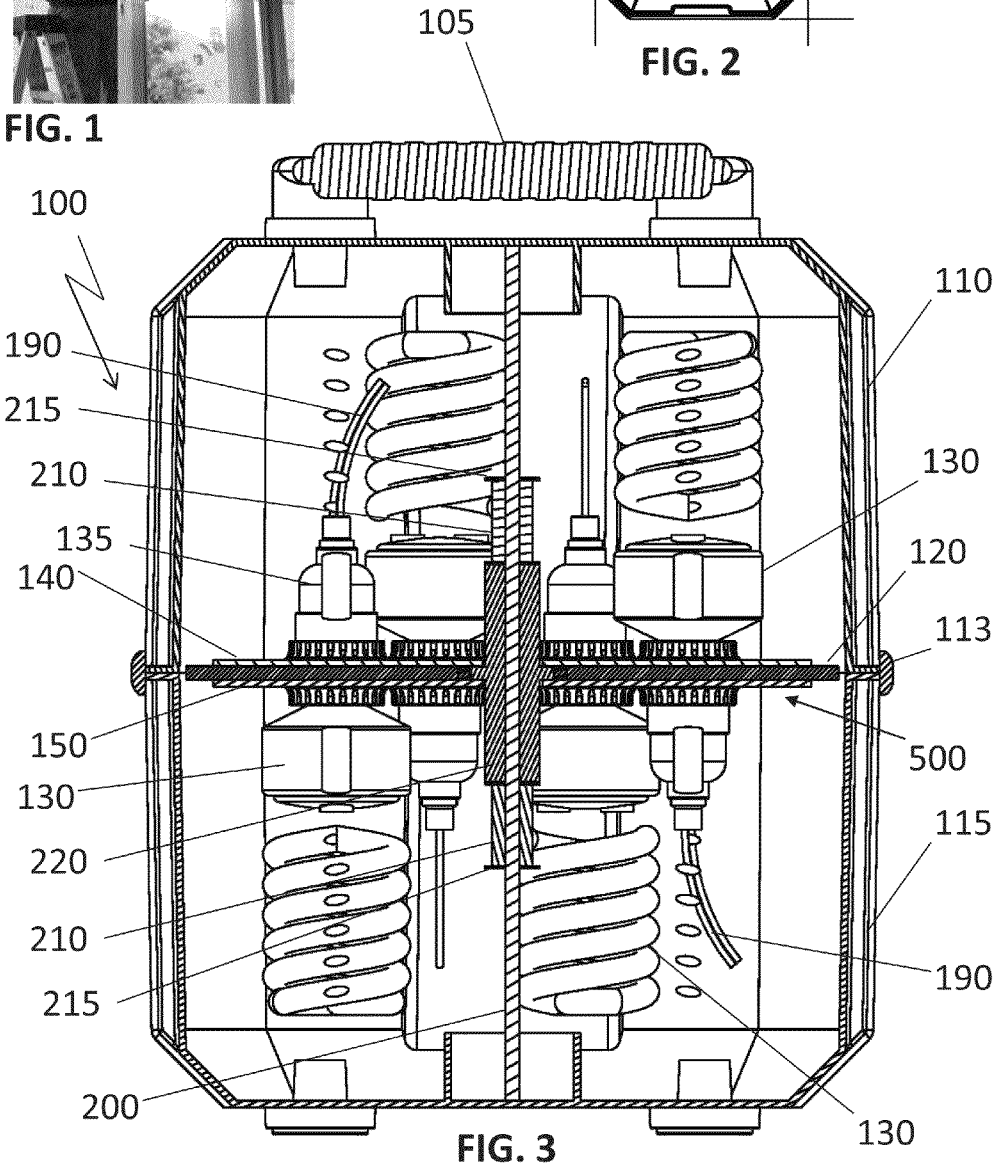
FIG. 3 is a sectional view along line 3-3 shown in FIG. 2.

FIG. 2 is a top elevation view of an exemplary embodiment of the lighting apparatus. FIG. 3 is a sectional view along line 3-3 shown in FIG. 2. As shown, the internal components are preferably encased by an upper housing 110 and lower housing 115. Preferably, the seal between the upper and lower housings 110 and 115 does not permit substantial water or even more preferably substantial water vapor from entering the interior. In an exemplary embodiment, a gasket 113 or other sealing means may be placed at the interface of the upper and lower housings 110 and 115 to further restrict the ability of contaminates from contacting the internal components.

A central column 200 is preferably placed in the center of the upper and lower housings 110 and 115 and positioned substantially vertically. In an exemplary embodiment, a collar 220 contains a pass through which accepts the central column 200 and allows the collar 220 to slide vertically along the central column 200. A socket assembly 500 is preferably fixed to the collar 220 so that the socket assembly 500 is permitted to move up/down vertically along with the collar 220. The socket assembly 500 preferably contains a plurality of sockets 135 which are fixed to a flexible substrate 120, which has been fixed to the collar 220.

In an exemplary embodiment, the flexible substrate 120 may be sandwiched between an upper rigid substrate 140 and a lower rigid substrate 150, where the rigid substrates 140 and 150 are fixed to the collar 220. The collar 220 is preferably sandwiched between a pair of shock-absorbing devices 210, which may comprise a spring, rubber/elastomer, or soft plastic. In some embodiments, the shock-absorbing devices 210 may extend the entire length of the central column 200. In other embodiments, the shock-absorbing devices may have a shorter length, and held in place by a locating or fixing means 215 which may comprise a locating clip, retaining clip, threaded fastener, locking washer, or a portion of the central column 200 having a larger diameter or locating ledge.

A fluorescent lamp 130 may be inserted into each socket 135. A handle or grasping means 105 may be fixed to the upper housing 110. The upper and lower housings 110 and 115 may be comprised of a translucent material, preferably a plastic and even more preferably polycarbonate. Some embodiments may contain a textured surface on the interior and/or exterior of the upper and lower housings 110 and 115 to aid in the diffusion of light. Some embodiments may contain an additive to the plastic (if used) such as reflective particles to aid in the diffusion of light.

As shown in the Figures, sockets 135 and lamps 130 are placed so that light may be emitted from the apparatus in a substantially isotropic pattern. In other words, light is emitted from all sides of the apparatus, preferably in a substantially equal manner. This allows the apparatus to be oriented in any number of positions (above the work area, next to the work area, below the work area, etc.) and still provide adequate light. Further, the use of fluorescent lights provides an increase in efficiency and produces very little heat when compared to other technologies. Thus, the apparatus may be used in close proximity to heat sensitive or flammable objects without the risks that are inherent in other technologies. The flexible substrate 120 allows the lamps 130 and sockets 135 to oscillate when the apparatus is under some type of shock and/or vibration, preventing damage to both. Further, the ability for the socket assembly 500 to travel vertically while utilizing the shock absorbing devices 210, allows the apparatus to absorb even further shock and/or vibration without damage to the lamps 130 and sockets 135.

In some embodiments, reflective substrates may be positioned within the upper and lower housings 110 and 115 so that emitted light may be intensified in a particular direction. In other words, if a user is working near or onto a floor/ground surface, a reflective substrate may be positioned near the top of upper housing 110 so that a portion of the light may be reflected down, thus increasing the intensity of the light on the floor/ground. In another scenario, if a user is working on a wall surface, a reflective substrate may be positioned on a side of the upper or lower housings 110 and 115 (or both the upper and lower housings 110 and 115) that opposes the wall surface so that a portion of the light may be reflected towards the wall surface. In this way, the same apparatus can function in both an isotropic mode as well as a semi-directional mode. The reflective substrates can be any device which reflects a large portion of the light while absorbing only a small amount. Preferably, the reflective substrates would be plastic or metallic and they can be flexible or rigid. The reflective substrates may be secured within the upper or lower housings 110 and 115 by any number of mechanical retaining means, including but not limited to: mechanical fasteners, clips, slots, tabs, or snap features.

Figure 4:
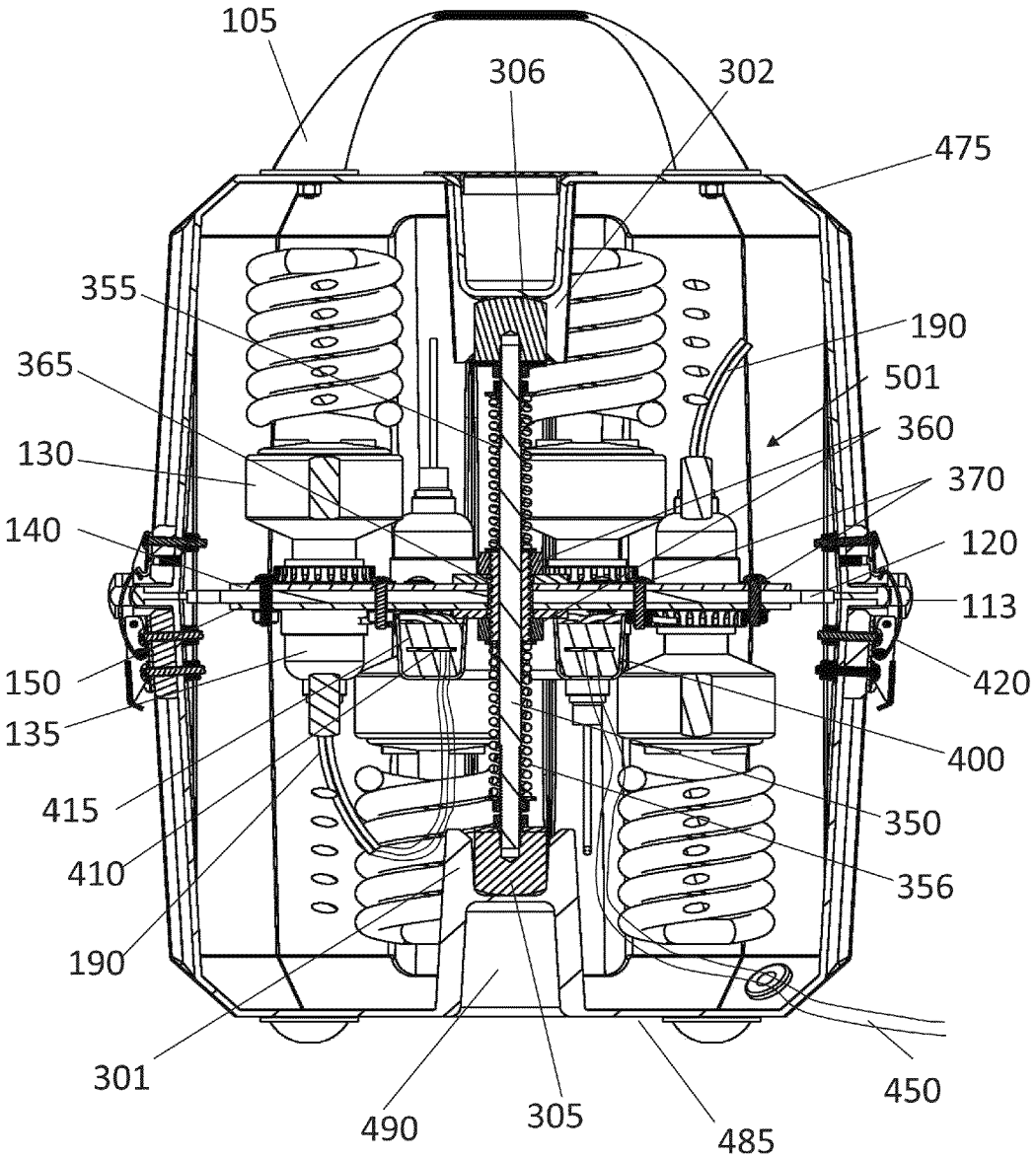
FIG. 4 is a sectional view of another embodiment, taken along line 3-3 shown in FIG. 2.

FIG. 4 is a sectional view of another embodiment, taken along line 3-3 shown in FIG. 2. As shown, the socket assembly 501 is preferably encased by an upper housing 475 and lower housing 485. Preferably, the seal between the upper and lower housings 475 and 485 does not permit substantial water or even more preferably substantial water vapor from entering the interior. In an exemplary embodiment, a gasket 113 or other sealing means may be placed at the interface of the upper and lower housings 475 and 485 to further restrict the ability of contaminates from contacting the internal components. One or more latches 420 may be used to close/open the upper housing 475 and lower housing 485. The lower housing 485 may contain an aperture 490 for accepting a post, pole, or pipe—which may be used with a common tri-pod or light stand.

A central column 350 is preferably positioned near the center of the upper and lower housings 475 and 485 and positioned substantially vertically. In this embodiment, the upper housing 475 contains a cavity 302 positioned near the center of the top of the upper housing 475. Similarly, the lower housing 485 contains a cavity 301 positioned near the center of the bottom of the lower housing 485. A first end of the central column 350 is preferably positioned within cavity 302 while a second end of the central column 350 is preferably positioned within cavity 301. In an exemplary embodiment, the first end of the central column 350 is held within a compressible block 306 which fits within cavity 302. Similarly, the second end of the central column 350 is held within a compressible block 305 which fits within cavity 301. The compressible blocks 305 and 306 may be any number of materials, but would preferably be a soft plastic, rubber, or elastomer. The compressible blocks 305 and 306 may serve to further reduce the shock to the socket assembly 501 when there is shock to the housings 475/485.

In this exemplary embodiment, a collar 365 contains a pass through which accepts the central column 350 and allows the collar 365 to slide vertically along the central column 350. The socket assembly 501 is preferably fixed to the collar 365 so that the socket assembly 501 is permitted to move up/down vertically along with the collar 365. The socket assembly 501 preferably contains a plurality of sockets 135 which are fixed to a flexible substrate 120, which has been fixed to the collar 365.

In an exemplary embodiment, the flexible substrate 120 may be sandwiched between an upper rigid substrate 140 and a lower rigid substrate 150, where the resulting assembly is fixed to the collar 365. Here, the flexible substrate 120 is held between the rigid substrates 140/150 by using fasteners 370. This collar 365 contains threads on the outer surface which interact with female threaded members 360 such that as the female threaded members 360 are attached to the collar 365 they tighten against the rigid substrates 140/150 so as to fix the socket assembly 501 onto the collar 365. In other words, the female threaded members 360 act to squeeze together and hold the rigid substrates 140/150 and flexible substrate 120 relative to the collar 365.

A first spring 355 is positioned on the central column 350, between the collar 365 and the first end of the central column 350 (or the compressible block 306/cavity 302). A second spring 356 is positioned on the central column 350, between the collar 365 and the second send of the central column 350 (or the compressible block 305/cavity 301). The springs 356/355 may travel the entire exposed length of the central column 350 or spacers may be positioned on the central column 350.

In this embodiment, a fluorescent lamp 130 may be inserted into each socket 135. A handle or grasping means 105 may be fixed to the upper housing 110. The upper and lower housings 475 and 485 may be comprised of a translucent material, preferably a plastic and even more preferably polycarbonate. Some embodiments may contain a textured surface on the interior and/or exterior of the upper and lower housings 475 and 485 to aid in the diffusion of light. Some embodiments may contain an additive to the plastic (if used) such as reflective particles to aid in the diffusion of light.

In this embodiment, an electrical assembly is attached to the socket assembly 501 so that it can also move up/down along the central column 350. Here, this electrical assembly comprises a circuit board 410 which is housed within a housing 400. The circuit board 410 is preferably in electrical communication with the sockets 135 through wiring 190 (note that for simplicity not all of the wiring 190 has been shown in this figure). Also, the wiring 450 for the incoming power is also in electrical communication with the circuit board 410. The housing 400 is preferably filled with potting material 415 in order to provide strain relief and protection to the electrical connections within as well as to electrically isolate the circuit board 410 and the electrical connections.

Figure 5:
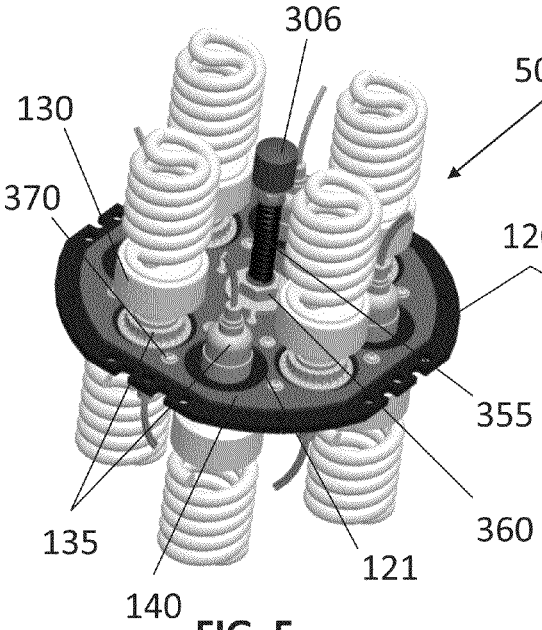
FIG. 5 is a top perspective view of an exemplary embodiment of the socket assembly.
Figure 6:
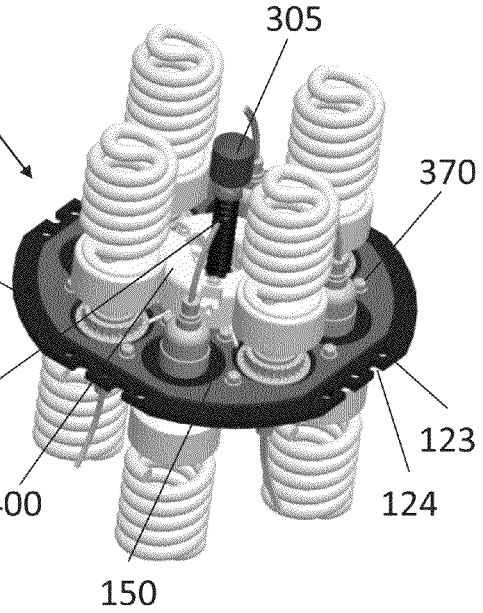
FIG. 6 is a bottom perspective view of an exemplary embodiment of the socket assembly.

FIG. 5 is a top perspective view of an exemplary embodiment of the socket assembly 501. FIG. 6 is a bottom perspective view of an exemplary embodiment of the socket assembly 501. The upper rigid substrate 140 and lower rigid substrate 150 contain voids 121 which surround each socket 135 such that each socket 135 is attached to only the flexible substrate 120. Each void 121 therefore can be described as a portion of the flexible substrate 120 which encircles each socket 135 so that during shock the socket 135 is permitted to rotate and/or flex up/down in order to absorb the shock without transferring it to the lamps 130.

The flexible substrate 120 also preferably extends past the rigid substrates 140/150 so as to create a perimeter of the flexible substrate 120 encircling the socket assembly 501. This flexible substrate 120 perimeter is adapted to impact the sides of the upper/lower housings 475/485 so as to further absorb any shock to the device. This perimeter may also contain holes 123 or notches 124 to further soften the flexible substrate 120 and improve its ability to absorb large amounts of shock. The holes 123 and notches 124 also permit the wiring 190 to pass from the sockets 135 to the electrical assembly and its housing 400.

Figure 7A:
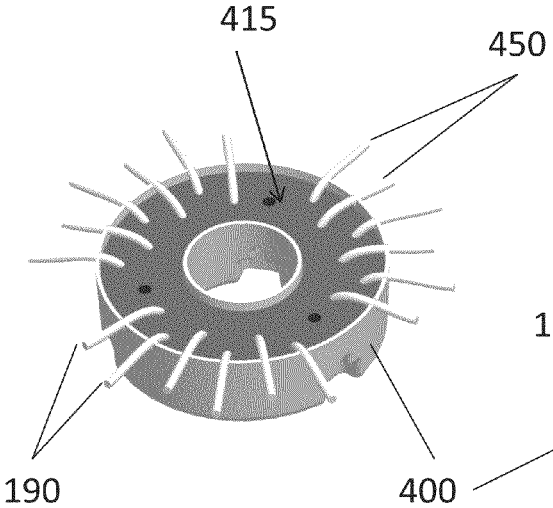
FIG. 7A is a perspective view of the electronics assembly.
Figure 7B:
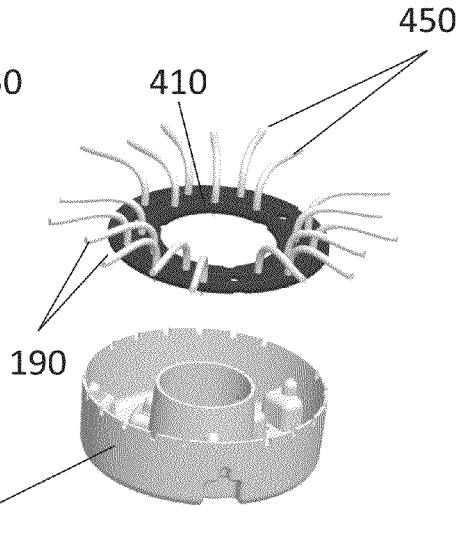
FIG. 7B is a perspective view of the electronics assembly where the potting material and circuit board have been removed from the donut housing.

FIG. 7A is a perspective view of the electronics assembly. Wiring 190 and 450 are shown exiting the potting material 415 which fills the housing 400. The housing 400 is donut shaped and contains a central pass through hole for accepting the central column 350. FIG. 7B is a perspective view of the electronics assembly where the potting material 415 and circuit board 410 have been removed from the donut housing.

Figure 8A:
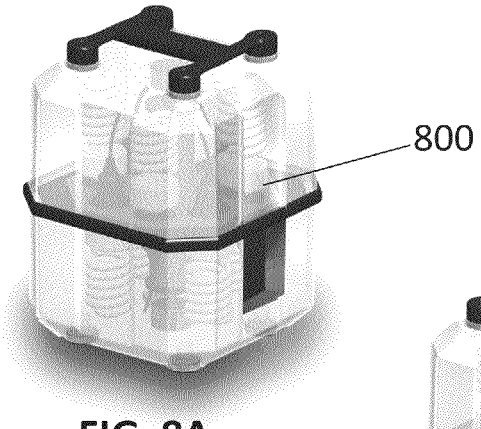
FIG. 8A is a perspective illustration of an alternative embodiment having a removable lighting subassembly.
Figure 8B:
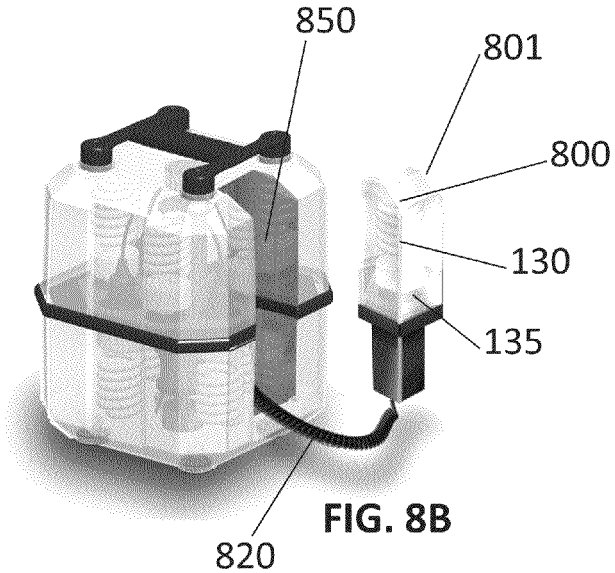
FIG. 8B is a perspective illustration of the embodiment shown in FIG. 8A where the removable lighting subassembly has been removed from the main housing.

FIGS. 8A-8B are illustrations of embodiments of the lighting apparatus having a removable lighting subassembly 800. Here, the upper/lower housings contain a pocket 850 for storing a removable lighting subassembly 800 which preferably contains at least one socket 135 and lamp 130 which is contained within its own translucent housing 801. Wiring 820 allows electrical communication between this socket 135 and the electrical assembly within the upper/lower housings. It should be noted that although the pocket 850 is comprised of portions of both the upper and lower housings this is not required, as the pocket 850 could be comprised of only the upper housing or comprised of only the lower housing.

Figure 9:
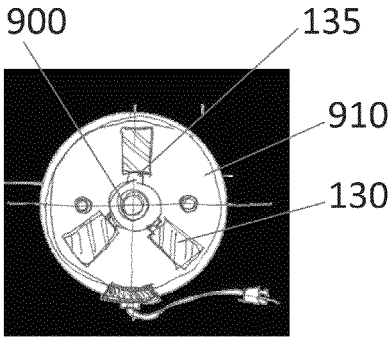
FIG. 9 is a top plan view of another embodiment using sockets which extend radially outward from a central column.
Figure 10:
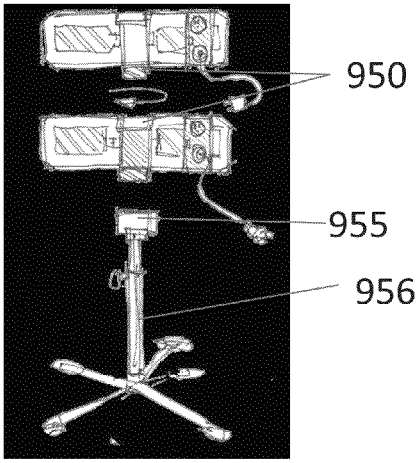
FIG. 10 is a front exploded view of the embodiment of the durable lighting apparatus shown in FIG. 9 being assembled with a second apparatus and atop a stand.

FIG. 9 is a top plan view of another embodiment using sockets 135 which extend radially outward from a central column 900. Two or more sockets 135 may extend radially outward from the central column 900, and are housed within a translucent housing 910. FIG. 10 is a front exploded view of the embodiment of the durable lighting apparatus shown in FIG. 9 being assembled with a second apparatus and atop a stand 956. Here, interacting threads 950 are positioned at the center top and center bottom of each apparatus so that they can be removably attached to one another by engaging the threads 950 with one another. The stand 956 also contains a threaded portion 955 for accepting the threads 950 from one of the lighting apparatuses.

Figure 11:
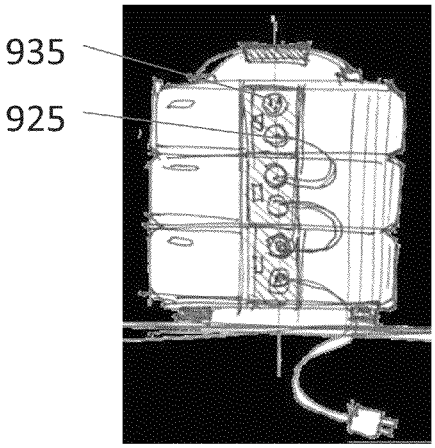
FIG. 11 is a front elevation view of the embodiment of the durable lighting apparatus shown in FIG. 9 being assembled with a second and third apparatus and electrically connected to one another.

FIG. 11 is a front elevation view of the embodiment of the durable lighting apparatus shown in FIG. 9 being assembled with a second and third apparatus and electrically connected to one another. Here, each durable lighting apparatus contains an electrical socket 935 for accepting a traditional electrical plug and also contains a power input wire 925. When the power input wire 925 is connected to a power source, the electrical socket 935 may be energized. As such, each of the lighting apparatuses can be connected to one another by connecting the power input wire 925 with the electrical socket 935 of an adjacent lighting apparatus. Therefore, only one of the lighting apparatuses must be connected to a power source, while the remaining lighting apparatuses can be connected to one another. Grounded or ungrounded electrical plugs and wires can be used with any of the embodiments shown herein. The electrical socket 935 may be grounded or ungrounded.

It should be noted that although CFL type lamps and E26 Edison sockets are shown in the figures, any type of socket/lamp combination could be used with the embodiments herein. Specifically contemplated are LED based lamps which are compatible with E26 Edison sockets.

Having shown and described a preferred embodiment of the invention, those skilled in the art will realize that many variations and modifications may be made to affect the described invention and still be within the scope of the claimed invention. Additionally, many of the elements indicated above may be altered or replaced by different elements which will provide the same result and fall within the spirit of the claimed invention. It is the intention, therefore, to limit the invention only as indicated by the scope of the claims.

We claim:

1. A durable lighting apparatus comprising:
a translucent housing that is portable;
a substrate positioned within the translucent housing;
a plurality of light sockets positioned on the substrate;
electrical connections between a power input wire and the light sockets,
wherein the substrate is permitted to move relative to the translucent housing when a shock is applied to the translucent housing.

2. The durable lighting apparatus of claim 1 wherein:
the light sockets extend radially from a center column within the translucent housing.

3. The durable lighting apparatus of claim 1 wherein:
the substrate is attached to a collar which can slide vertically along a central column.

4. The durable lighting apparatus of claim 1 further comprising:
a first threaded portion located on a top of the housing; and
a second threaded portion located on a bottom of the housing and adapted to engage with the first threaded portion of another durable lighting apparatus.

5. The durable lighting apparatus of claim 1 further comprising:
the substrate which accepts each socket is flexible.

6. The durable lighting apparatus of claim 1 further comprising:
a handle attached to the housing.

7. The durable lighting apparatus of claim 1 further comprising:
an electrical socket within the housing which is powered once the power input wire has been powered.

8. The durable lighting apparatus of claim 1 wherein:
the light sockets are positioned substantially equidistantly about a horizontal circle placed within a center portion of the translucent housing.

9. The durable lighting apparatus of claim 1 wherein:
the light sockets are positioned so that each light socket is located at a substantially equal radial distance from a vertical center axis.

10. A durable lighting apparatus comprising:
a translucent housing having a center portion;
a central column positioned vertically within the center portion of the translucent housing;
a collar positioned on the central column and adapted to slide along the central column;
a first shock-absorbing device positioned on the central column and above the collar;
a second shock-absorbing device positioned on the central column and below the collar; and
a light socket assembly attached to the collar and containing a plurality of light sockets.

11. The durable lighting apparatus of claim 10 wherein:
the light socket assembly comprises a flexible substrate sandwiched between an upper rigid substrate and a lower rigid substrate.

12. The durable lighting apparatus of claim 11 wherein:
the light sockets are attached to the flexible substrate.

13. The durable lighting apparatus of claim 12 further comprising:
voids within the upper rigid substrate and lower rigid substrate and centered on each of the light sockets.

14. The durable lighting apparatus of claim 10 further comprising:
a flexible substrate within the light socket assembly and adapted to receive each of the light sockets.

15. The durable lighting apparatus of claim 10 further comprising:
a power input wire; and
electrical connections between the power input wire and the plurality of light sockets, the electrical connections comprising:
an electrical housing,
a circuit board in electrical communication with each socket and the power input wire, and
potting material surrounding the circuit board and filling the electrical housing.

16. The durable lighting apparatus of claim 15 wherein:
the electrical housing is attached to the light socket assembly.

17. A durable and portable lighting apparatus comprising:
a lower translucent housing;
an upper translucent housing placed atop the lower translucent housing;
a substrate positioned horizontally within the upper and lower housings;
a first light socket attached to the substrate so that a lamp, when placed in the first light socket, will extend downwardly from the substrate and into the lower translucent housing; and
a second light socket attached to the substrate so that a lamp, when placed in the second light socket, will extend upwardly from the substrate and into the upper translucent housing,
wherein the substrate is positioned within the upper and lower housings so that the substrate is permitted to move relative to the upper and lower housings when a shock is applied to the upper and lower housings.

18. The durable and portable lighting apparatus of claim 17 wherein:
the upper and lower housings meet at an interface and the substrate is positioned substantially in line with the interface of the upper and lower housings.

19. The durable and portable lighting apparatus of claim 18 further comprising:
a gasket positioned at the interface of the upper and lower housings.

* * * * *